US009098030B2

(12) United States Patent
Sasaki et al.

(10) Patent No.: US 9,098,030 B2
(45) Date of Patent: Aug. 4, 2015

(54) IMAGE FORMING APPARATUS

(71) Applicant: Konica Minolta, Inc., Chiyoda-ku (JP)

(72) Inventors: Kosuke Sasaki, Yokohama (JP); Yasuhiro Ishihara, Toyohashi (JP); Toshiaki Tanaka, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/221,412

(22) Filed: Mar. 21, 2014

(65) Prior Publication Data

US 2014/0286666 A1 Sep. 25, 2014

(30) Foreign Application Priority Data

Mar. 22, 2013 (JP) ..... 2013-059695

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2078; G03G 15/2082; G03G 2215/2016
USPC ..... 399/69, 324, 329
See application file for complete search history.

(56) References Cited

U.S. PATENT DOCUMENTS

2003/0161650 A1* 8/2003 Tatematsu et al. ..... 399/69
2007/0140719 A1* 6/2007 Sato ..... 399/69

FOREIGN PATENT DOCUMENTS

JP 2002-311750 A 10/2002
JP 2005-142023 6/2005
JP 2012-088533 5/2012

OTHER PUBLICATIONS

Notification of Reasons Refusal issued in corresponding Japanese Patent Application No. 2013-059695, mailed Mar. 10, 2015, with English translation thereof.

* cited by examiner

*Primary Examiner* — David Bolduc
*Assistant Examiner* — Barnabas Fekete
(74) *Attorney, Agent, or Firm* — Buchanan Ingersoll & Rooney PC

(57) ABSTRACT

An image forming apparatus having: an endless fixing belt; a heating member heating the fixing belt; a support member maintaining the fixing belt substantially circular; a pressing member in contact with the fixing belt to form a fixing nip portion; a temperature sensor; a position detector; a storage storing temperatures and positions of the fixing belt detected by the temperature sensor and the position detector; and a control unit. The control unit is operable in a characteristic storing mode and in a fixing mode. In the characteristic storing mode, temperatures of the fixing belt associated with positions are detected, and the detected temperatures and positions are stored in the storage. In the fixing mode, temperatures of the fixing nip portion are predicted with reference to the temperatures and positions stored in the storage, and the heating member is controlled such that the predicted temperatures become a target temperature.

17 Claims, 10 Drawing Sheets

IMAGE FORMING APPARATUS

This application claims the benefit of Japanese Patent Application No. 2013-059695 filed on Mar. 22, 2013, the content of which is incorporated herein by reference.

BACKGROUND OF THE INVENTION

1. Field of the Invention

The present invention relates to an image forming apparatus, and more particularly to an electrophotographic image forming apparatus, such as a printer, a copying machine or the like, that transfers a toner image on a sheet and fixes the toner image on the sheet by heat.

2. Description of Related Art

In an electrophotographic image forming apparatus, generally, a sheet with a toner image transferred thereon is fed to a fixing nip portion between a fixing roller and a pressure roller. At the fixing nip portion, heat is applied to the sheet such that the toner image thereon can be fixed on the sheet. It is necessary that the fixing nip portion is maintained at a predetermined temperature. As a method of predicting the temperature of the fixing nip portion, for example, Japanese Patent Laid-Open Publication No. 2002-311750 suggests that the temperature upstream of the fixing nip portion is predicted by use of two temperature sensors, or by use of one temperature sensor and on the basis of the thermophysical property of the fixing roller.

Recently, a fixing device using an endless fixing belt made by extrusion of resin, which permits costless mass production, instead of a fixing roller has been put into practical use. Such a fixing belt has fluctuation in thickness (size in the diameterical direction) for manufacturing reasons. Accordingly, when the fixing belt is heated by a constant amount of energy, the fixing belt fluctuates in temperature depending on the position along the circumferential direction. Therefore, the temperature detection result obtained by monitoring of the temperature of a portion other than the fixing nip portion by use of a temperature sensor may be different from the temperature of the fixing nip portion. The fixing nip portion is an area nipped between the fixing belt and a pressing member, and it is impossible to directly measure the temperature of the fixing nip portion by use of a temperature sensor because of its structure. Also, when the temperature of the fixing nip portion is measured from the inner surface of the belt, the thermal capacity of the belt has an effect on the measurement result. Thus, it is impossible to measure the temperature of the nip portion accurately.

SUMMARY OF THE INVENTION

The present invention provides an image forming apparatus measuring the temperature of a fixing nip portion accurately although a fixing belt, of which temperature is likely to vary depending on the position in the circumferential direction, is used, and further controlling the temperature of the fixing nip portion accurately.

In an image forming apparatus according to an embodiment, a toner image transferred to a sheet is fixed thereon by heat, and the image forming apparatus comprises: an endless fixing belt located to come into contact with the toner image; a heating member configured to apply heat to the fixing belt from an inside or an outside of the fixing belt; a support member located in a space enclosed by the fixing belt and configured to maintain the fixing belt in a substantially circular form; a pressing member in contact with an outer circumference of the fixing belt to form a fixing nip portion; a temperature sensor configured to detect a temperature of the outer circumference of the fixing belt; a position detector configured to detect a position of the fixing belt in a circumferential direction; a storage configured to store the temperature detected by the temperature sensor and the position detected by the position detector; and a control unit configured to control at least the heating member, the temperature sensor, the position detector and the storage. The control unit is operable in a characteristic storing mode and in a fixing mode. The characteristic storing mode is carried out at a time other than a fixing operation, and in the characteristic storing mode, temperatures of the fixing belt associated with positions in the circumferential direction are detected by use of the temperature sensor and the position detector, and the detected temperatures and positions are stored in the storage. The fixing mode is carried out during the fixing operation, and in the fixing mode, temperatures of the fixing nip portion are predicted with reference to the temperatures and the positions stored in the storage, and the heating member is controlled such that the predicted temperatures become a target temperature.

DETAILED DESCRIPTION OF THE PREFERRED EMBODIMENTS

Figure 1:
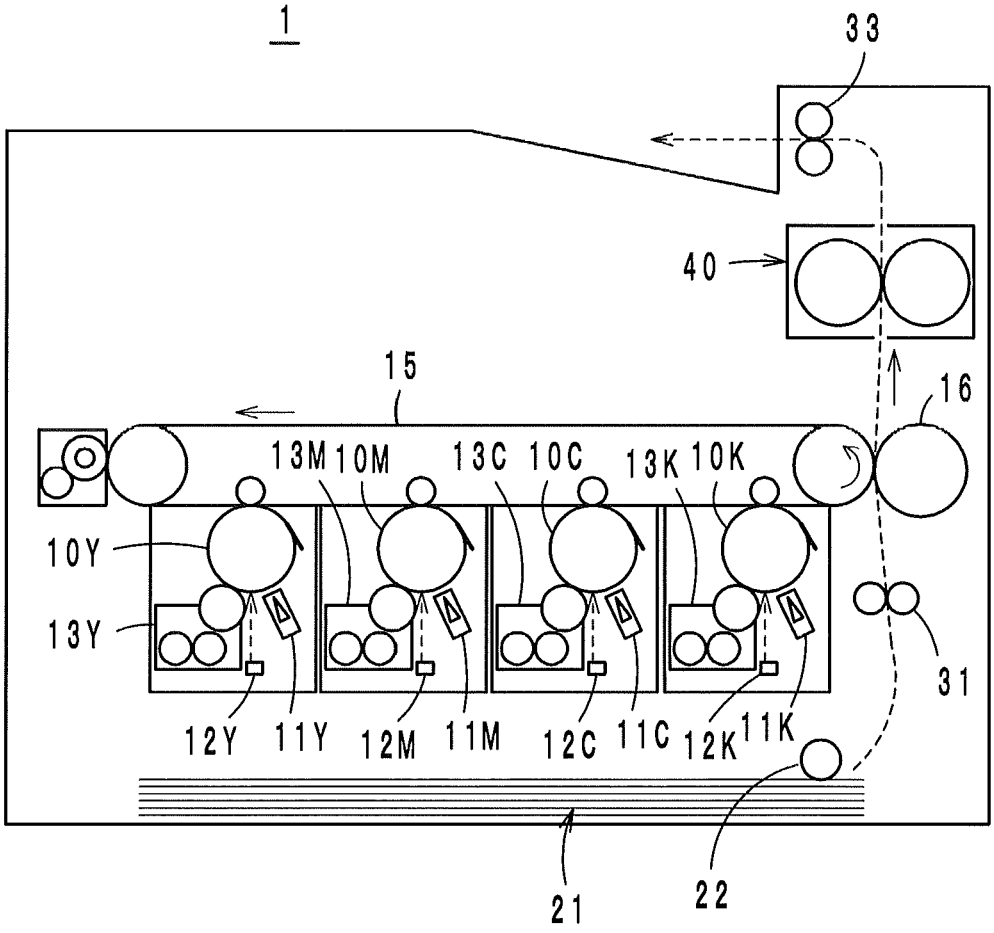
FIG. 1 is a skeleton framework of an image forming apparatus according to an embodiment of the present invention.

An image forming apparatus according to an embodiment of the present invention will be hereinafter described with reference to the drawings. In the drawings, same members and parts are provided with same reference marks, and repetitions descriptions are avoided.

First, an image forming apparatus 1 according to an embodiment is described with reference to FIG. 1. The image forming apparatus 1 is configured to form a color image in a tandem method. The image forming apparatus 1 comprises photoreceptor drums 10Y, 10M, 10C and 10K, which are to form images of yellow, magenta, cyan and black, respectively, arranged side by side. Toner images formed on the photoreceptor drums 10Y, 10M, 10C and 10K are transferred to an intermediate transfer belt 15 and are combined to become a composite toner image (primary transfer), and the composite toner image is transferred to a sheet by the effect of an electric field applied from a transfer roller 16 (secondary transfer). Around the respective photoreceptor drums 10Y, 10M, 10C and 10K, chargers 11Y, 11M, 11C and 11K, exposure devices 12Y, 12M, 12C and 12K, developing devices 13Y, 13M, 13C and 13K, etc. are provided so as to form images by an electrophotographic process. The electrophographic process is well known, and a description thereof is omitted.

Sheets are stacked in a sheet feeder 21 and are picked up one by one by a feed roller 22. A picked-up sheet is fed to a secondary transfer area through a pair of resist rollers 31, and a toner image is transferred to the sheet (secondary transfer). Thereafter, the sheet is fed to a fixing device 40, and the toner image is fixed on the sheet by heat. Then, the sheet is ejected on an upper surface of the apparatus 1 through a pair of ejection rollers 33.

Figure 2:
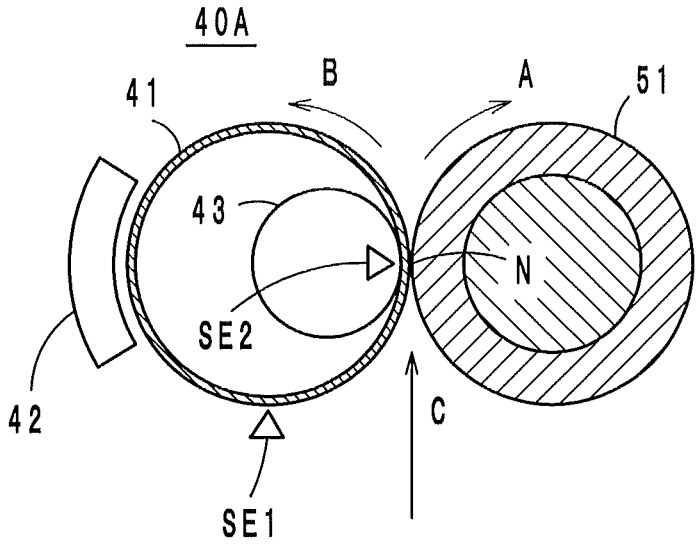
FIG. 2 is a schematic sectional view of a first example of fixing device.

In the following, a first example, a second example and a third example of the fixing device 40 are described. The first example 40A of fixing device, as shown by FIG. 2, comprises an endless fixing belt 41 (shaped like a hollow cylinder), a pressure roller 51 leaning against the outer circumference of the fixing belt 51 at specified pressure to form a nip portion N, and a conventional electromagnetic induction heater 42 for applying heat to the fixing belt 41. The fixing belt 41 is made by extrusion of resin. A support roller 43 is provided inside the hollow cylinder of the fixing belt 41 to maintain the fixing belt 41 substantially circular. In other words, the fixing belt 41 is elastic and flexible enough to be maintained substantially circular by a nip between the support roller 43 and the pressure roller 51. The pressure roller 51 is driven to rotate in a direction shown by arrow A. Following the rotation of the pressure roller 51, the fixing belt 41 rotates in a direction shown by arrow B while maintained substantially circular. The sheet is fed to the fixing nip portion N in a direction shown by arrow C while the surface having a transferred toner image thereon faces the fixing belt 41.

Figure 13:
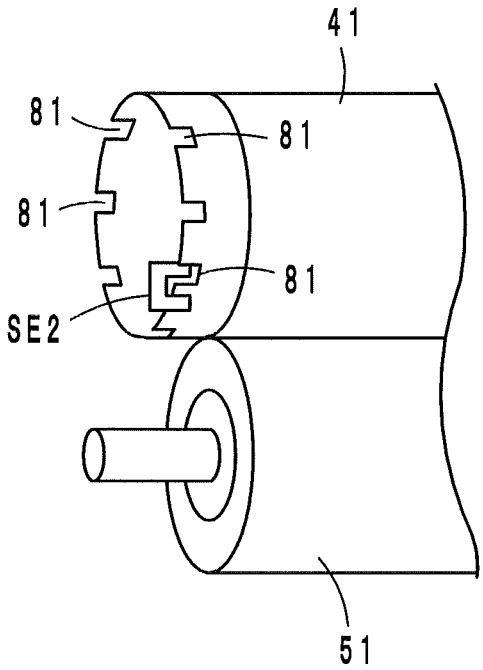
FIG. 13 is a perspective view of an end portion of the fixing belt showing an arrangement for detecting the phase of the fixing belt.

The fixing belt 41 is made by extrusion of resin, and a heat-resistant resin material, such as silicon rubber, fluorine-containing rubber or the like, is suited for the fixing belt 41. A temperature sensor SE1 is disposed near the outer circumference of the fixing belt 41, and a phase detector SE2 is disposed near the inner circumference of the fixing belt 41. As the temperature sensor SE1, a thermistor or a thermopile is used. The phase detector SE2 is to detect the position in the circumferential direction of the fixing belt 41 with reference to a home position, and a description thereof will be given later with reference to FIG. 13.

Figure 3:
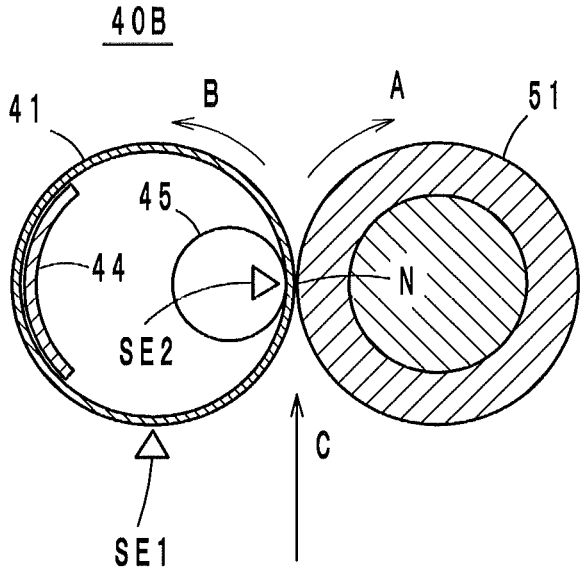
FIG. 3 is a schematic sectional view of a second example of fixing device.

A second example 40B of fixing device, as shown by FIG. 3, comprises a fixing belt 41 as described above, a pressure roller 51 as described above, a support member 44 and a halogen heater 45. The halogen heater 45 is in contact with the inner circumference of the fixing belt 41 at the fixing nip portion N and applies heat to the fixing belt 41 from the inside of the hollow cylinder of the fixing belt 41. In the same way as the first example, the second example 40B has a temperature sensor SE1 and a phase detector SE2.

Figure 4A:
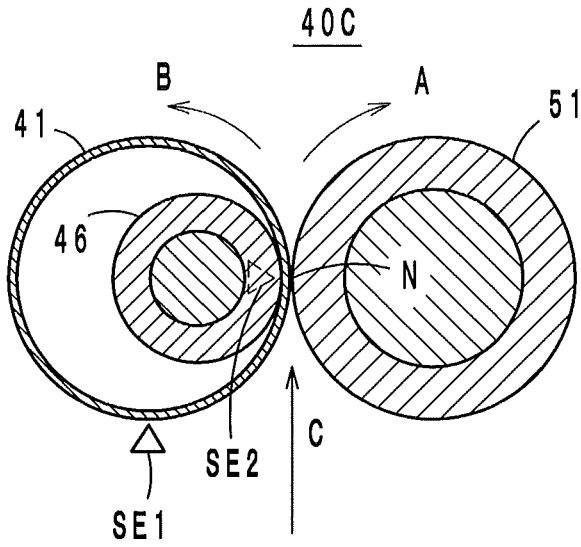
FIGS. 4A and 4B show a third example of fixing device, FIG. 4A being a schematic sectional view and FIG. 4B being a perspective view.
Figure 4B:
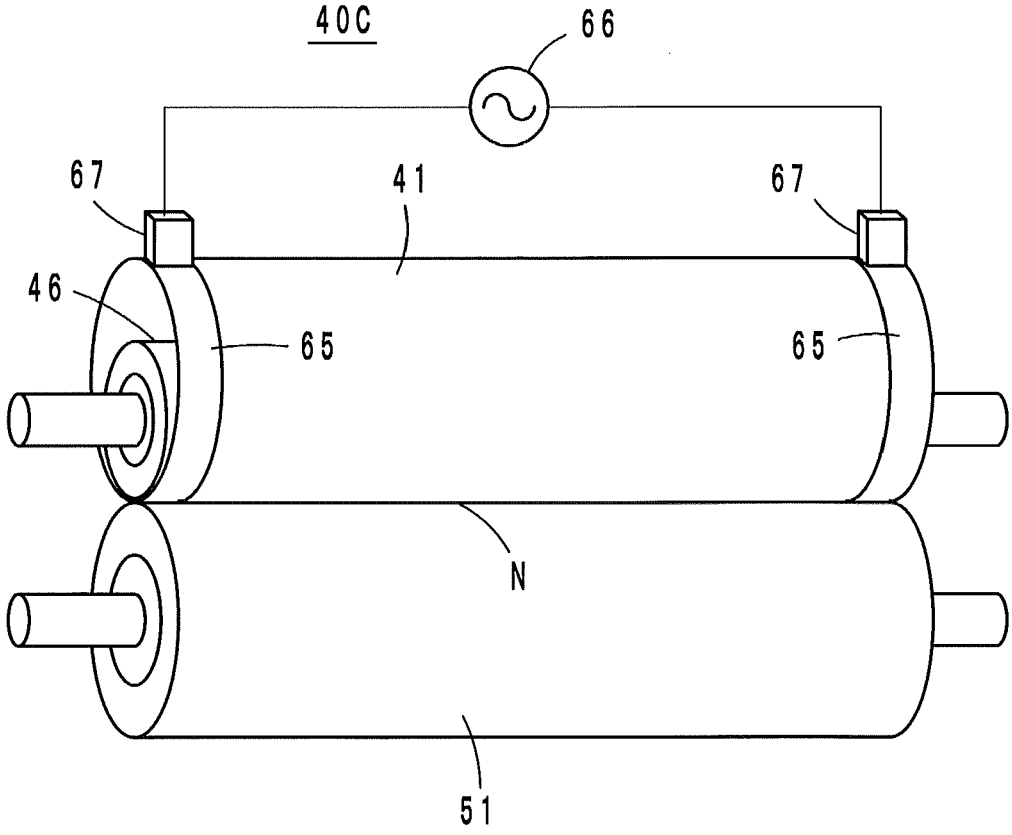
Figure 5:
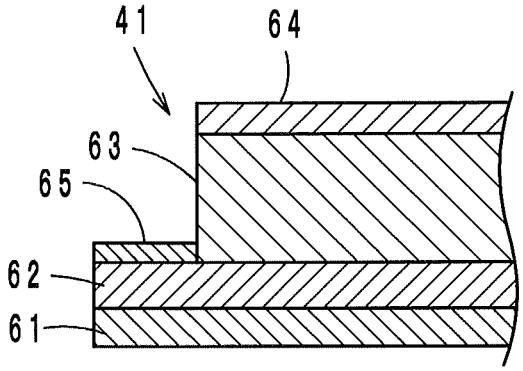
FIG. 5 is a sectional view of a main part of the third example of fixing device.

A third example 40C of fixing device, as shown by FIGS. 4 and 5, comprises a fixing belt 41, a pressure roller 51 as described above and a support roller 46. In the same way as the first example, the second example 40B has a temperature sensor SE1 and a phase detector SE2.

As shown by FIG. 5, the fixing belt 41 in the third example 40C is of a four-layer structure comprising an insulating layer 61, a resistance heating layer 62, an elastic layer 63 and a release layer 64. The elastic layer 63 is made by extrusion of resin into an endless (hollow-cylindrical) shape, and specifically, a heat-resistant resin material, such as silicon rubber, fluorine-containing rubber or the like, is used as the material of the fixing belt 41. Opposite end portions of the resistance heating layer 62 protrude from the elastic layer 63, and electrodes 56 are disposed on the entire circumferences of the respective protruding portions. Feed elements 67 are disposed on the electrodes 65, and the feed elements 67 are connected to a power source 66 of a pulse-control type. Electric power is supplied from the feed elements 67 to the resistance heating layer 62 via the electrodes 65. Thereby, the resistance heating layer 62 generates heat, and the elastic layer 63 is heated.

The fixing belt 41 in the first and the second examples and the elastic layer 63 in the third example are made by extrusion of resin into an endless shape. Therefore, the fixing belt 41 and the elastic layer 63 have a problem peculiar to extrusion-molded products, that is, a problem of having fluctuation in thickness. As mentioned in the description of related art, when the fixing belt 41 or the elastic layer 63 is heated by a fixed amount of energy, the temperature of the fixing belt 41 or the elastic layer 63 varies depending on the position in the circumferential direction. In this embodiment, however, although the fixing belt 41 has such a temperature characteristic, accurate temperature prediction and accurate temperature control of the fixing nip portion N are intended.

Figure 6:
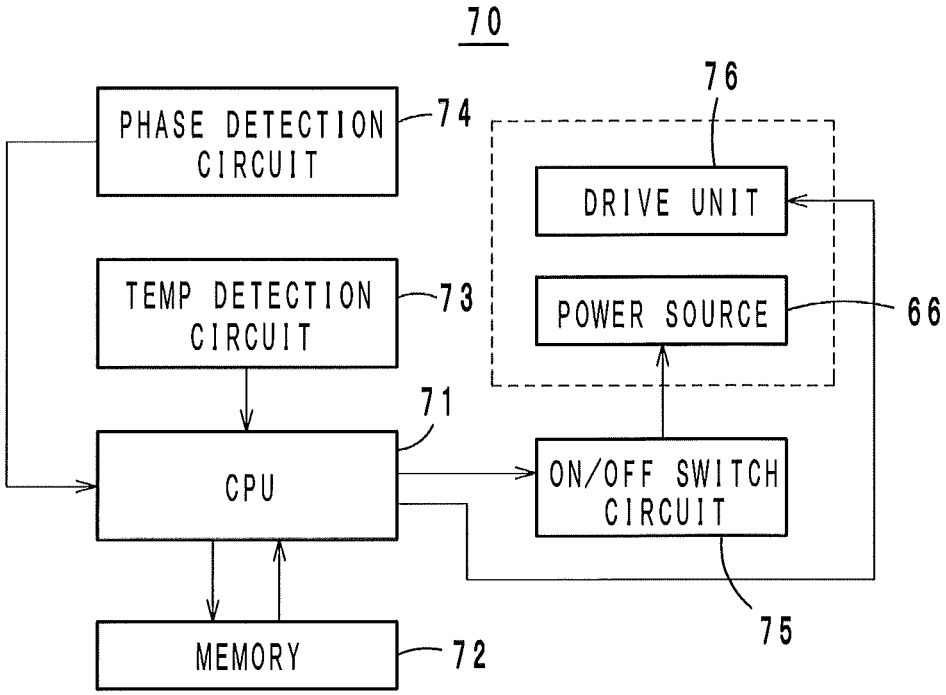
FIG. 6 is a block diagram showing a control unit for controlling the fixing device.

As shown by FIG. 6, a control unit 70 for controlling the fixing device 40 has a CPU 71 as a main element, and further comprises a memory (storage) 72, a temperature detection circuit 73 including the temperature sensor SE1, and a phase detection circuit 74 including the phase detector SE2. The power source 66 is connected to the CPU 71 via an on/off switch circuit 75. The CPU 71 further controls a drive unit 76 for driving the pressure roller 51.

The CPU 71 is capable of controlling the fixing device 40 in a characteristic storing mode and in a fixing mode. The CPU 71 controls the fixing device 40 in the characteristic storing mode at a time other than an operation of the fixing device 40 for toner fixation (other than a fixing operation). In the characteristic storing mode, while a predetermined amount of electric power is supplied to the heater 42, 45 or the resistance heating layer 62 to heat the fixing belt 41, temperatures of the fixing belt 41 associated with various positions in the circumferential direction are detected by use of the temperature sensor SE1 and the phase detector SE2, and the detected temperatures associated with the positions are stored in the memory 72. The CPU 71 controls the fixing device 40 in the fixing mode while the fixing device 40 operates for toner fixation (during the fixing operation). In the fixing mode, the temperature at the fixing nip portion N is predicted from the positions and the temperatures stored in the memory 72, and the CPU 71 controls the heater 42, 45 or the power source 66 such that the predicted temperature will become a target temperature. The heaters 42, 45 and the resistance heating layer 62 will be hereinafter referred to as heating members.

Figure 7:
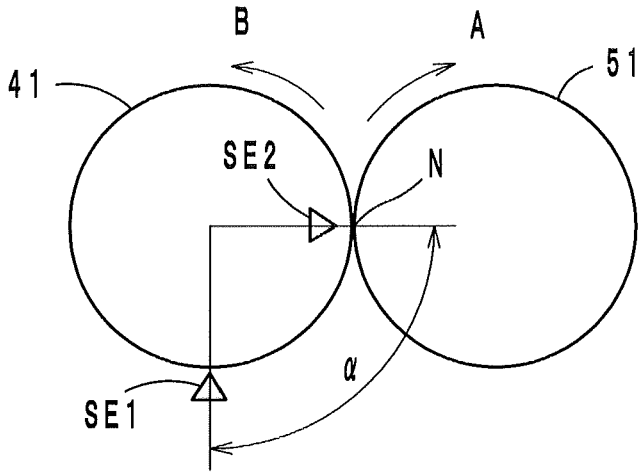
FIG. 7 is an illustration showing the positional relation between a temperature sensor and a phase detector for a fixing belt.

In the following, the detection of temperatures and the prediction of temperature of the fixing nip portion N are described. The temperature sensor SE1 and the phase detector SE2 are located at positions as shown by FIG. 7 with respect to the circumferential direction of the fixing belt 41. When the fixing nip portion N is assumed as a home position, the phase detector SE2 detects the phase at the home position, and the temperature sensor SE1 detects the temperature of the outer circumference of the fixing belt 41 at a position with a phase difference of $\alpha$ from the home position (at an angle of substantially 90 degrees to the home position). Accordingly, the portion of the fixing belt 41 of which temperature is detected by the temperature sensor SE1 will reach the fixing nip portion N with a phase shift of $\alpha$. During an operation in the fixing mode, the temperature of the fixing belt 41 detected by the temperature sensor SE1 when the phase detector SE2 detects a phase $\theta$ of the fixing belt 41 is denoted by $Ta(\theta)$, and the temperature of the fixing nip portion N at that time is denoted by T1.

Figure 8:
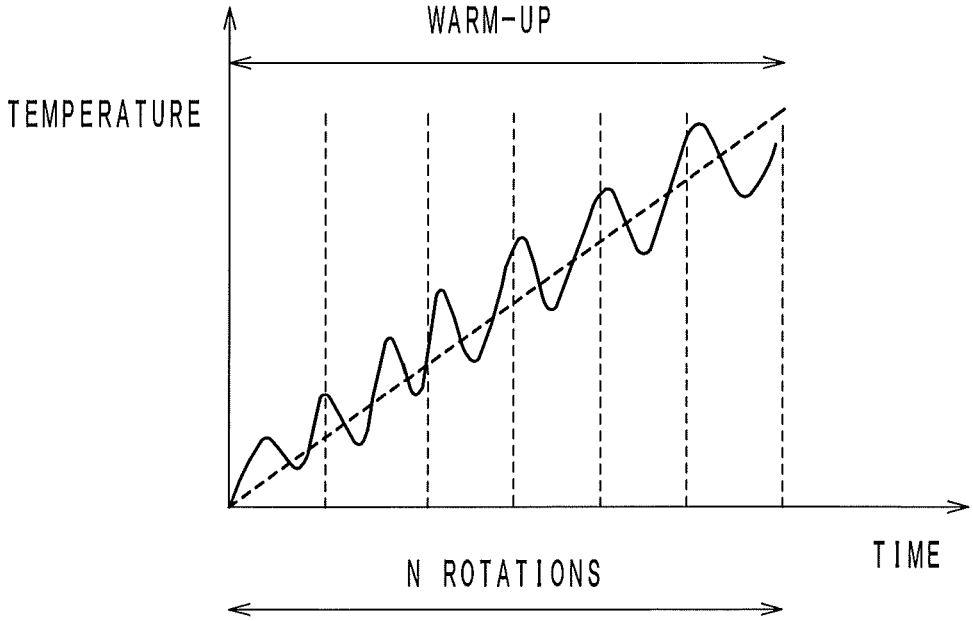
FIG. 8 is a graph showing temperature change of the fixing belt during a warm-up operation.

The characteristic storing mode can be carried out in various states of the image forming apparatus 1. In the following, a case where the characteristic storing mode is carried out during a warm-up operation is described. First, the fixing belt 41 is controlled to make N rotations while the fixing belt 41 and the pressure roller 51 are pressed against each other at a predetermined pressure. In the meantime, the electric power supplied to the heating member is constant, and the temperature of the fixing belt 41 is detected with each phase shift of the belt 41. For example, when the fixing belt 41 has a diameter of 30 mm, the circumference of the belt 41 is 94 mm, and in this case, the temperature of the fixing belt 41 is detected with each 1 mm-movement of the fixing belt 41. Then, the results are stored in the memory 72. In FIG. 8, the solid line shows detected temperature values, and the dashed line shows a temperature-rise characteristic. In this case, it is desired that the temperature of the fixing belt 41 all through the entire circumference rises along the temperature-rise characteristic. Actually, however, due to variations in thickness of the fixing belt 41, the temperature of the fixing belt 41 rises while making a periodical change with rotation of the fixing belt 41 as shown by the solid line. The temperature-rise characteristic with a constant slope results from the supply of a constant amount of energy to the heating member.

Figure 9:
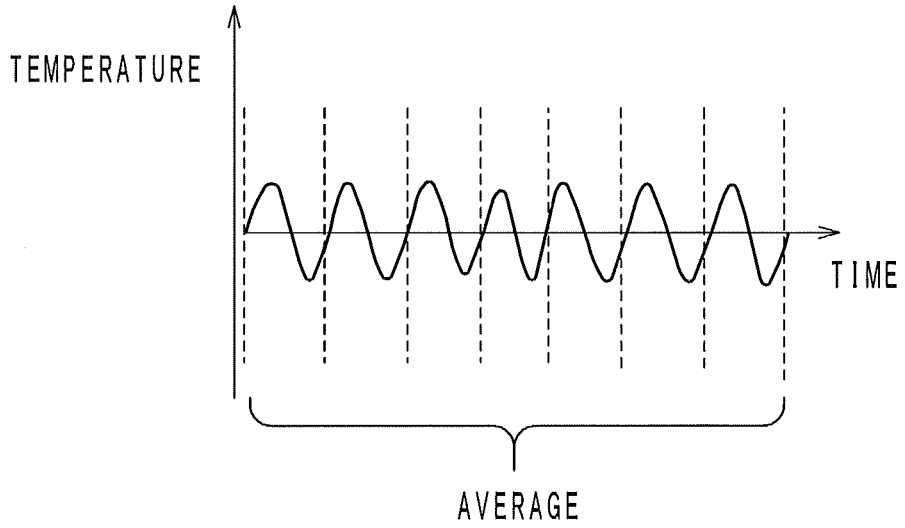
FIG. 9 is a graph obtained by making corrections to detected values shown in FIG. 8.

A temperature rise per unit time is subtracted from the detected temperatures during the heating of the fixing belt 41 (values as shown in FIG. 8), and the resultant values are stored in the memory 72. In this way, the detected values are corrected to values as shown in FIG. 9 with the slope of temperature rise assumed to be zero. The temperature characteristic shown by FIG. 9 corresponds to temperature variation caused by the thickness variation of the fixing belt 41. Further, in order to minimize effects of possible errors in detecting the temperature and the phase, an averaging process of averaging the measured values during N rotations of the fixing belt 41 may be carried out.

Figure 10:
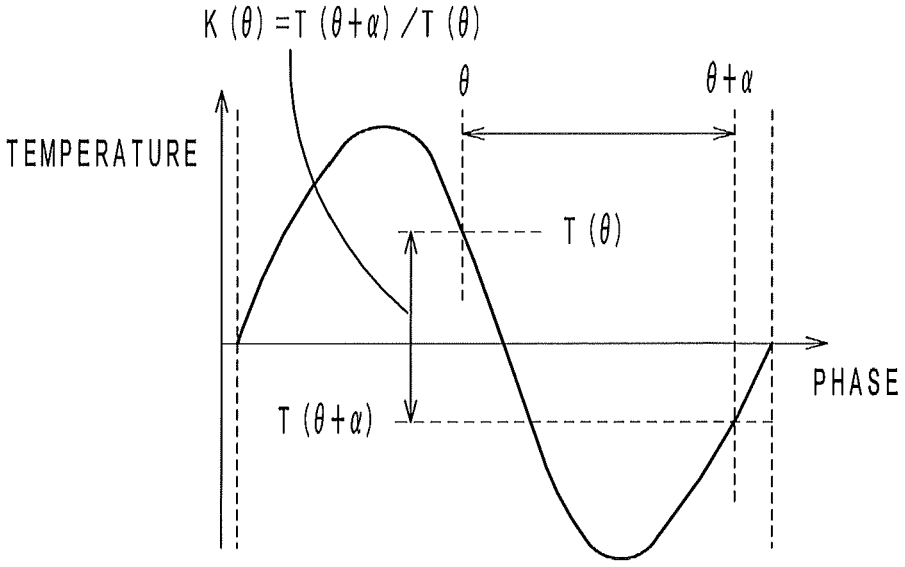
FIG. 10 is a graph showing temperature prediction in the characteristic storing mode.

For an actual fixing operation, correction values $K(\theta)$ used for prediction of the temperature of the nip portion N are calculated from the values shown by FIG. 9. Next, a way of calculating each correction value $K(\theta)$ is described with reference to FIG. 10. The temperature T1 of the fixing nip portion N is calculated by $K(\theta)\times Ta(\theta)$. The correction value $K(\theta)$ is calculated from the data shown by FIG. 9 as a ratio of a value $T(\theta+\alpha)$ to a value $T(\theta)$. That is, $K(\theta)=T(\theta+\alpha)/T(\theta)$. The value $T(\theta)$ is a value shown in FIG. 9 as an output from the temperature sensor SE1 when the phase detector SE2 detected the phase $\theta$, and the value $T(\theta+\alpha)$ is a value shown in FIG. 9 as an output from the temperature sensor SE1 when the phase detector SE2 detected a position with a phase shift of $\alpha$ from the phase $\theta$. The phase shift of a corresponds to the phase difference between the fixing nip portion N and the location of the temperature sensor SE1.

In the fixing mode, as described above, the temperature of the fixing nip portion N is predicted from the data about position (phase) and temperature stored in the memory 72, and the heating member is controlled such that the predicted temperature will become a target temperature (180° C.). The control in the fixing mode is conventional, and a description thereof is omitted.

Figure 11:
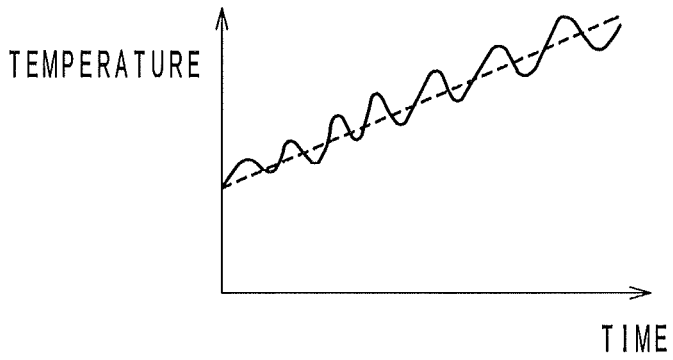
FIG. 11 is a graph showing temperature change of the fixing belt in a warm-up period

The characteristic storing mode can be carried out at any time as long as the image forming apparatus 1 is powered on. It is preferred that the characteristic storing mode is carried out when the fixing belt 41 is replaced with a new one. It is because different fixing belts have different thickness variation characteristics. Carrying out the characteristic storing mode during a warm-up operation as described above is time-saving. The characteristic storing mode may be carried out immediately before the start of each image forming job. In this case, as shown by FIG. 11, temperature data are collected during heating of the fixing belt 41 at a constant temperature-rise rate (see the dashed line). In this case also, a temperature rise per unit time is subtracted from the values detected by the temperature sensor SE1, and the resultant values are stored in the memory 72.

Figure 12:
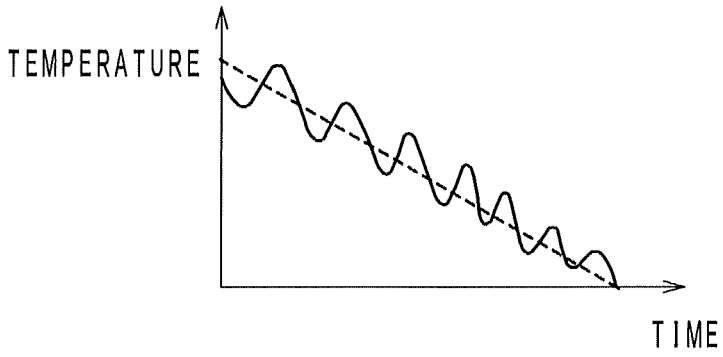
FIG. 12 is a graph showing temperature change of the fixing belt during a cool-down period.

Also, the characteristic storing mode may be carried out during cooling of the fixing belt 41 (for example, after completion of an image forming operation). In this case, as shown by FIG. 12, temperature data are collected while the fixing belt 41 is cooled at a constant temperature-drop rate (see the dashed line). In this case, a temperature drop per unit time is subtracted from the temperatures detected by the temperature sensor SE1, and the resultant values are stored in the memory 72. In the case of carrying out the characteristic storing mode during cooling of the fixing belt 41, no electric power is supplied to the heating member. Therefore, this is energy-saving. Further, carrying out the characteristic storing mode during a cool-down period immediately after completion of an image forming operation is also time-saving.

The phase (the position in the circumferential direction) of the fixing belt 41 can be detected in the following way. A plurality of slits 81 are made at an end of the fixing belt 41, and the phase detector SE2 detects the slits 81. Also, for example, one of the slits 81 is made deeper, and the home position can be detected by detecting the position of the deeper slit by use of another photosensor. A linear pattern may be used instead of the slits 81. There are other ways of detecting the phase of the fixing belt 41. It is preferred that the phase of the fixing belt 41 is detected in or around the fixing nip portion N so as to avoid phase detection errors caused by deformation and/or distortion that may occur with rotation of the fixing belt 41.

Figure 14:
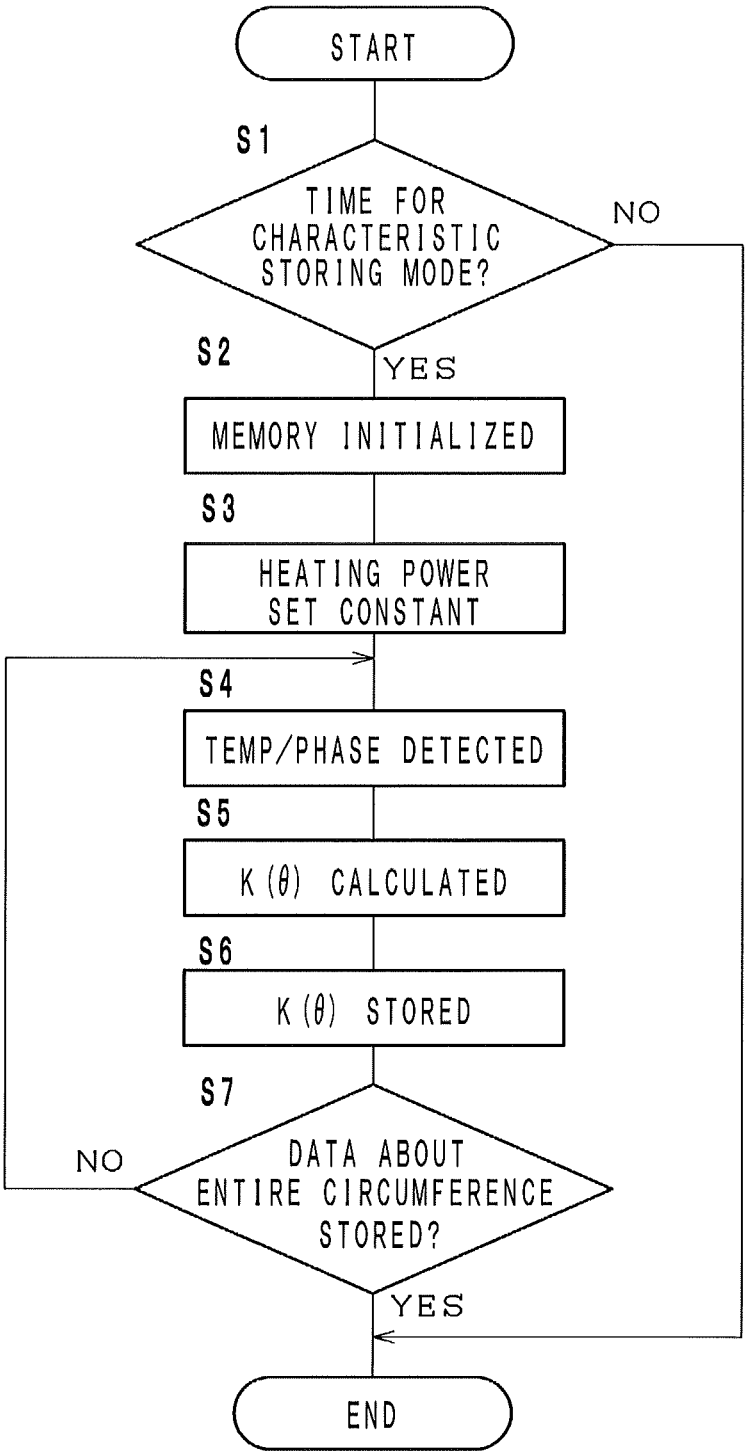
FIG. 14 is a flowchart showing a control procedure in a characteristic storing mode.

Next, a procedure for carrying out the characteristic storing mode is described with reference to the flowchart shown by FIG. 14. When it comes to a time to carry out the characteristic storing mode (YES at step S1), the memory 72 is initialized (step S2) to erase the data stored therein. In a case of updating the data in the memory 72 at each time of carrying out the characteristic storing mode, the step S2 can be omitted. Subsequently, the electric power supplied to the heating member is set constant (step S3).

Next, while the electric power is supplied to the heating member, the temperature and the phase of the fixing belt 41 are detected (step S4). It is preferred that the temperature/phase detection is performed at intervals of a time shorter than the time required for one rotation of the fixing belt 41. For example, the detection is performed every time the circumference of the fixing belt 41 moves 1 mm. Next, a correction value $K(\theta)$ is calculated by $T(\theta+\alpha)/T(\theta)$ (step S5), and the calculated correction value $K(\theta)$ is stored in the memory 72, being associated with the phase (step S6). The steps S4 to S6 are repeated until data about the entire circumference of the fixing belt 41 have been stored, that is, the steps S4 to S6 are repeated as long as the result at step S7 is NO. Storage of data about the entire circumference is completed before the temperature of the fixing belt 41 reaches a target temperature. The target temperature may be a fixing temperature at which a fixing operation is actually carried out or a specific temperature predetermined for the characteristic storing mode. This procedure is completed with confirmation that data about the entire circumference of the fixing belt 41 have been stored (YES at step S7).

Figure 15:
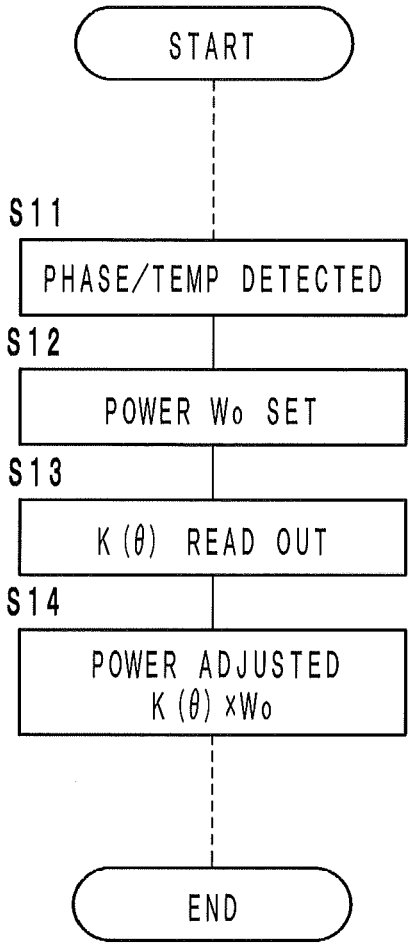
FIG. 15 is a flowchart showing a control procedure in a fixing mode.

FIG. 15 shows a main part of the fixing mode. During a fixing operation, the phase and the temperature of the fixing belt 41 are detected (step S11), and the amount of electric power supplied to the heating member is set to Wo (step S12). Also, the temperature of the fixing nip portion N is predicted from the detection results and a correction value $K(\theta)$ read out from the memory 72 (step S13). Then, the amount of electric power supplied to the heating member is adjusted such that the predicted temperature becomes a target temperature for the fixing operation (step S14). The predicted temperature, as described above, is $K(\theta)\times Ta(\theta)$. When the amount of electric power ordinarily supplied to the heating member to achieve the target temperature (180° C.) is assumed as Wo, the amount of electric power Wx supplied to the heating member is set to $K(\theta)\times Wo$ at step S14.

The calculation of correction values $K(\theta)$ may be performed not during the characteristic storing mode but during the fixing mode.

In the image forming apparatus according to the embodiment described above, although a fixing belt that is likely to have temperature variation in the circumferential direction is used, the temperature of the fixing nip portion can be preliminarily detected with a high degree of accuracy, which results in high-accuracy control of the temperature of the fixing nip portion.

Other Embodiments

Image forming apparatuses according to the present invention are not limited to the embodiment described above.

The present invention is applicable not only to color image forming apparatuses but also to monochromatic image forming apparatuses and multi-function machines having a communication function, a facsimile function, etc. The details of the fixing device may be arbitrarily designed.

Although the present invention has been described in connection with the preferred embodiment above, it is to be noted that various changes and modifications are possible for a person skilled in the art. Such changes and modifications are to be understood as being within the scope of the invention.

What is claimed is:

1. An image forming apparatus wherein a toner image transferred to a sheet is fixed thereon by heat, the image forming apparatus comprising:

an endless fixing belt located to come into contact with the toner image;

a heating member configured to apply heat to the fixing belt from an inside or an outside of the fixing belt;

a support member located in a space enclosed by the fixing belt and configured to maintain the fixing belt in a substantially circular form;

a pressing member in contact with an outer circumference of the fixing belt to form a fixing nip portion;

a temperature sensor configured to detect a temperature of the outer circumference of the fixing belt;

a position detector configured to detect a position of the fixing belt in a circumferential direction;

a storage configured to store the temperature detected by the temperature sensor and the position detected by the position detector; and a control unit configured to control at least the heating member, the temperature sensor, the position detector and the storage, wherein:

the control unit is operable in:

a characteristic storing mode to be carried out at a time other than a fixing operation, in which temperatures of the fixing belt associated with positions in the circumferential direction are detected by use of the temperature sensor and the position detector, and the detected temperatures and positions are stored in the storage; and a fixing mode to be carried out during the fixing operation, in which temperatures of the fixing nip portion is predicted with reference to the temperatures and the positions stored in the storage, and the heating member is controlled such that the predicted temperatures become a target temperature.

2. The image forming apparatus according to claim 1, wherein the position detector detects the position of the fixing belt in the circumferential direction in or around the fixing nip portion.

3. The image forming apparatus according to claim 1, wherein the position detector detects the position of the fixing belt in the circumferential direction by detecting a pattern formed on the fixing belt.

4. The image forming apparatus according to claim 1, wherein the control unit stores a correction value $K(\theta)=T(\theta+\alpha)/T(\theta)$ in the storage, in which $T(\theta)$ denotes the temperature detected by the temperature sensor when the position sensor detects a position $\theta$ during an operation in the characteristic storing mode, and $\alpha$ denotes a phase difference in the circumferential direction of the fixing belt between the temperature detector and a home position, and the control unit predicts the temperature of the fixing nip portion by calculating $K(\theta)\times Ta(\theta)$, in which $\theta$ denotes a phase angle of the fixing belt to the home position, and $Ta(\theta)$ denotes a temperature of the outer circumference of the fixing belt detected by the temperature sensor when the position detector detects the phase angle of $\theta$ of the fixing belt during an operation in the fixing mode.

5. The image forming apparatus according to claim 1, wherein the fixing belt is molded by extrusion of resin.

6. The image forming apparatus according to claim 1, wherein the heating member is of an electromagnetic induction type.

7. The image forming apparatus according to claim 1, wherein the heating member is a heater applying heat to the fixing belt from a position enclosed by the fixing belt.

8. The image forming apparatus according to claim 1, wherein the heating member is a resistance heating layer provided as a layer of the fixing belt.

9. The image forming apparatus according to claim 1, wherein the control unit operates in the characteristic storing mode while the heating member is supplied with a constant amount of electric power to heat the fixing belt.

10. The image forming apparatus according to claim 1, wherein the control unit operates in the characteristic storing mode when the fixing belt is replaced with a new one.

11. The image forming apparatus according to claim 1, wherein the control unit operates in the characteristic storing mode during a warm-up operation of the image forming apparatus.

12. The image forming apparatus according to claim 1, wherein the control unit operates in the characteristic storing mode during a warm-up period of the fixing belt.

13. The image forming apparatus according to claim 12, wherein when the control unit operates in the characteristic storing mode during a warm-up period of the fixing belt, values obtained by subtracting a temperature rise per unit time from the temperatures detected by the temperature sensor are stored in the storage.

14. The image forming apparatus according to claim 1, wherein the control unit operates in the characteristic storing mode after completion of an image forming operation.

15. The image forming apparatus according to claim 14, wherein the control unit operates in the characteristic storing mode while keeping the heating member from being supplied with electric power.

16. The image forming apparatus according to claim 1, wherein the control unit operates in the characteristic storing mode during a cool-down period of the fixing belt.

17. The image forming apparatus according to claim 16, wherein when the control unit operates in the characteristic storing mode during a cool-down period of the fixing belt, values obtained by subtracting a temperature drop per unit time from the temperatures detected by the temperature sensor are stored in the storage.

* * * * *